US006261616B1

(12) United States Patent
Simpson et al.

(10) Patent No.: US 6,261,616 B1
(45) Date of Patent: Jul. 17, 2001

(54) MICROWAVABLE MEAL KIT AND FOOD PACKAGING SYSTEM

(75) Inventors: Rodney J. Simpson, New Albany; Kamal N. Aboshamaa, Westerville, both of OH (US)

(73) Assignee: Bordon Foods Corporation, Columbus, OH (US)

( * ) Notice: Subject to any disclaimer, the term of this patent is extended or adjusted under 35 U.S.C. 154(b) by 0 days.

(21) Appl. No.: 09/552,240

(22) Filed: Apr. 19, 2000

Related U.S. Application Data

(63) Continuation-in-part of application No. 09/368,893, filed on Aug. 5, 1999.

(51) Int. Cl.[7] ..... B65D 77/30

(52) U.S. Cl. ..... 426/119; 426/106; 426/113; 426/396; 206/541; 206/564; 220/481; 229/103.2

(58) Field of Search ..... 420/119, 120, 420/113, 106, 124, 396; 220/480, 481; 206/564, 526, 499, 541; 229/406, 407, 103.2

(56) References Cited

U.S. PATENT DOCUMENTS

| | | | | |
|---|---|---|---|---|
| 4,796,411 | * | 1/1989 | Kimura et al. | 426/396 X |
| 5,039,001 | * | 8/1991 | Kinigakis et al. | 229/120 |
| 5,165,947 | * | 11/1992 | Colucci et al. | 426/396 X |
| 5,167,973 | * | 12/1992 | Snyder | 426/115 |
| 5,322,182 | * | 6/1994 | Fritz | 220/623 |
| 5,423,453 | * | 6/1995 | Fritz | 220/608 |
| 5,540,381 | * | 7/1996 | Davis | 229/103.2 |
| 5,593,610 | * | 1/1997 | Minerich et al. | 219/728 |
| 5,762,231 | * | 6/1998 | Rider, Jr. et al. | 220/526 |
| 5,888,565 | * | 3/1999 | Gics | 426/124 |
| 5,900,263 | * | 5/1999 | Gics | 426/119 X |
| 5,961,872 | * | 10/1999 | Simon et al. | 426/107 X |
| 6,048,558 | * | 4/2000 | Feldmeier et al. | 426/120 |

* cited by examiner

*Primary Examiner*—Gabrielle Brouillette
*Assistant Examiner*—Hao Mai
(74) *Attorney, Agent, or Firm*—Mueller and Smith, LPA

(57) ABSTRACT

A microwavable food packaging system includes a tray formed from a base and a sidewall extending from the base which sidewall terminates in a free edge. The base and sidewall define an interior cavity. The free edge defines a tray opening. The base has a raised button extending into the cavity. A sleeve surrounds the tray. The sleeve includes a front panel having a display surface and is disposed adjacent to the tray opening and a rear panel disposed adjacent to the base. The sleeve adjacent to the base extends outwardly to form a leg upon which the sleeve and tray can be upstandingly placed. The tray is adapted to receive food pouches within the cavity. The raised button stabilizes the center of gravity of the food packaging system when the food packaging system is placed in an upstanding position on the leg. Advantageously, at least one food pouch disposed in the cavity. The tray opening may be covered with the polymeric film that is sufficiently self-supporting to serve as a splatter guard by being placed over the tray opening when the tray is placed into a microwave for heating of food in the tray cavity.

43 Claims, 14 Drawing Sheets

14

34
12
26
36
66
24
68
60

FIG. 13
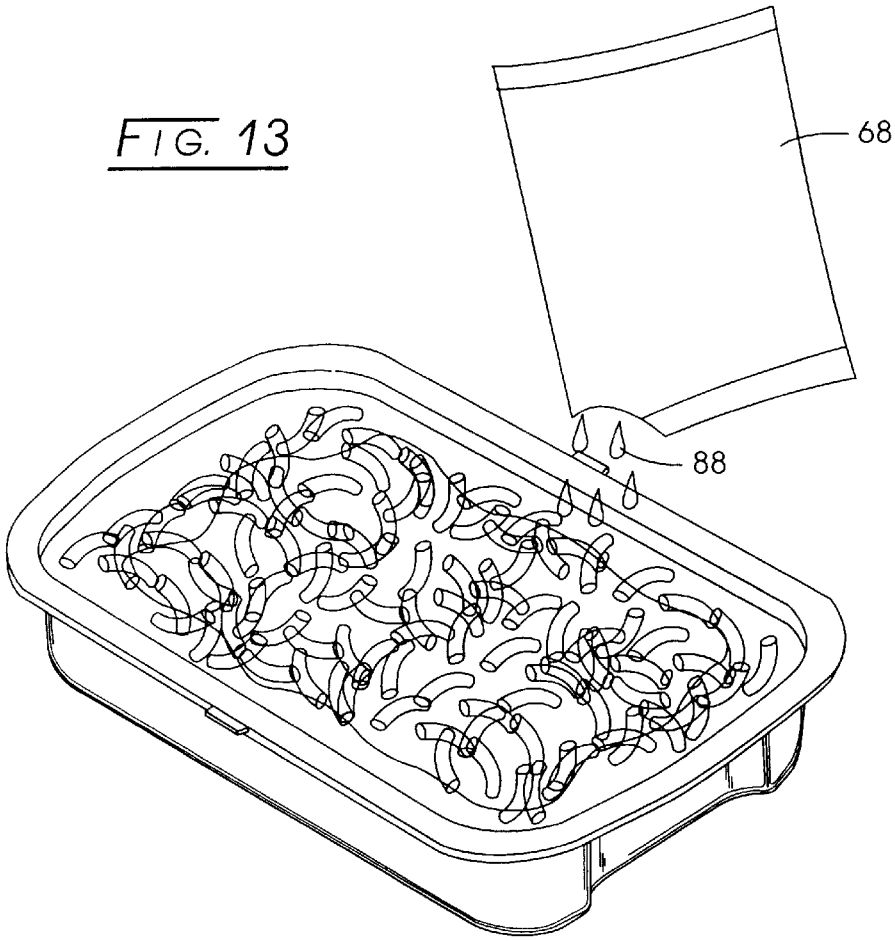
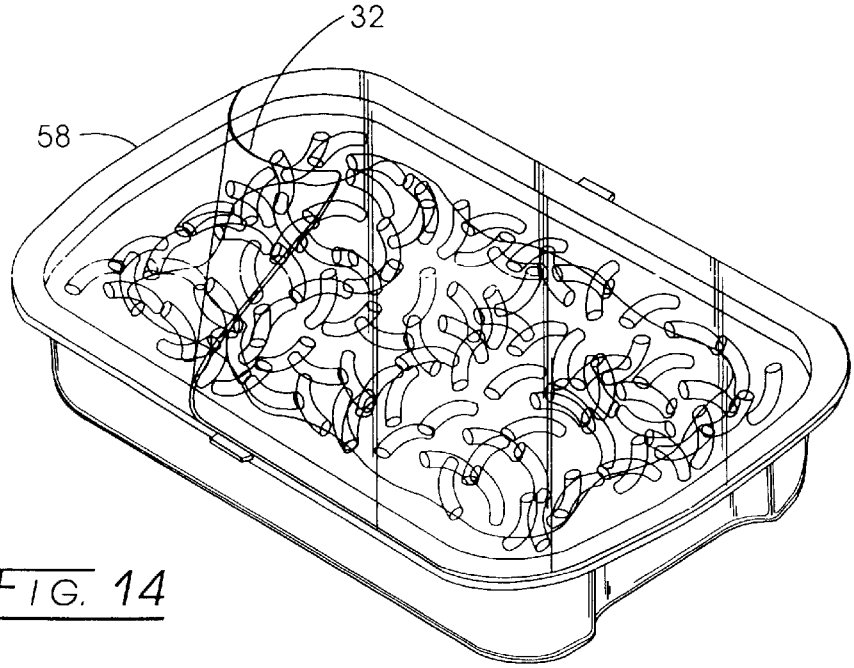
FIG. 14

FIG. 15
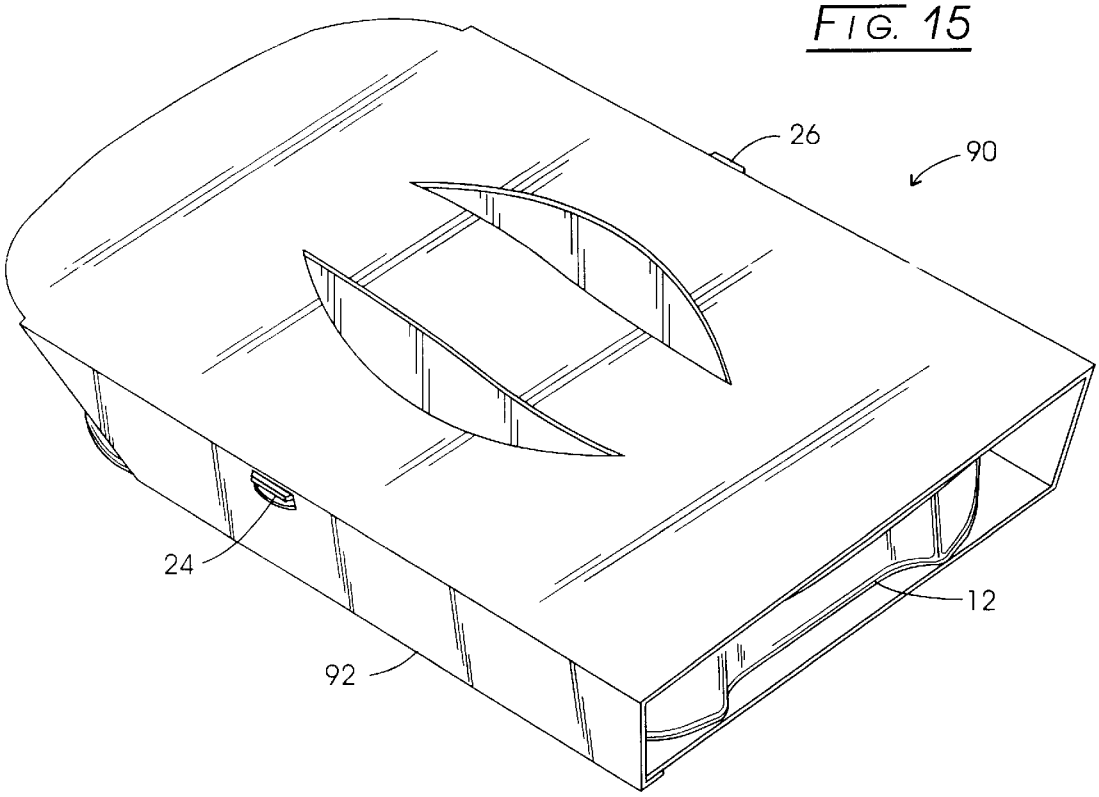
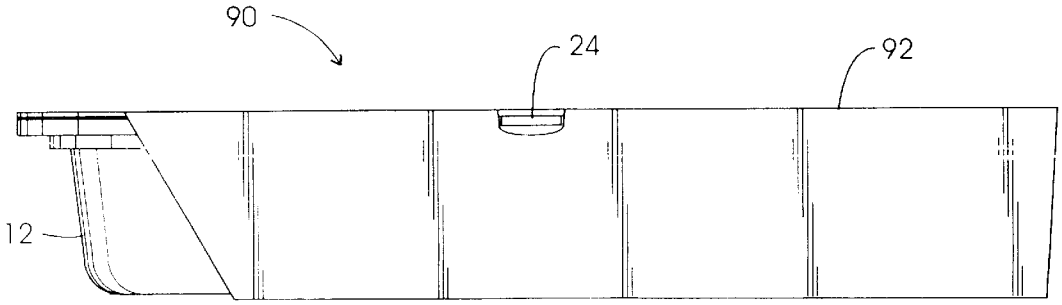
FIG. 16

MICROWAVABLE MEAL KIT AND FOOD PACKAGING SYSTEM

CROSS-REFERENCE TO RELATED APPLICATIONS

This application is a continuation-inn-part of application Ser. No. 09/368,893 filed Aug. 5, 1999, the disclosure of which is expressly incorporated herein by reference.

STATEMENT REGARDING FEDERALLY SPONSORED RESEARCH

Not applicable.

BACKGROUND OF THE INVENTION

The present invention relates to shelf-stable food packaging and more particularly to such packaging that is especially adapted for housing microwavable packaged meal kits.

Since the development of the microwave oven, there has been a continuing consumer desire for microwave-ready packaged meal kits. However, consumers desire meal kits that are convenient to use, are cooked evenly by the microwave, and taste like homemade food. Consumers additionally desire the meal kits to be efficient and economic in use. If such packaged meal kits are shelf-stable (i.e., can be stored under ambient temperature conditions and do not require refrigeration and/or freezing for storage), then both consumers and retailers are pleased.

Retailers prefer packaging that can be placed on existing shelves and do not require special handling from bulk shipping on pallets to final stocking of the items on the store shelf. Too, the packaging must remain intact during handling at the store and at home by the consumer. Storage of the packaging by the consumer is yet another criteria to which the packing designer must respond. The manufacturer desires packaging that attracts consumer attention by readily presenting product information in a relatively large, colorful display area. When the manufacturer is successful in its product packaging design, so too will be the retailers because consumers will purchase the item. Sometimes the packaging designer will be forced to compromise between cost effective packaging and packaging that presents the product in a favorable light, such as by presenting a relatively large label area with interest-provoking impact and insight into the meal contents to stimulate appeal. When the packaging designer has succeeded in his endeavor, the sales will please both the manufacturer and the retailer.

In this regard, prior designs include U.S. Pat. No. 5,900,263 which proposes a food package that includes an open-top tray surmounted by a paperboard sleeve wherein a rigid leg extends from the back of the sleeve so that the package stands upright on a store shelf. U.S. Pat. No. 5,743,402 proposes a similarly designed package wherein the sleeve and/or a clear plastic film is adhesively secured to a flange that the tray opening bears.

In the field of pasta meals, it would be advantageous to produce a prepackaged pasta meal having the above-described packaging advantages, while offering a convenient pasta meal that has desirable organoleptic properties. In the past, shelf-stable pasta for consumer use has been limited to packaging in glass jars which contain both the sauce and condiments, if any, mixed therewith. This method of storage fails to maintain the organoleptic properties of the pasta over time. The use of glass jars requires extra handling precaution by the retailer as well as the consumer. Typical pasta in a jar also is not meant to be heated by the consumer in a microwave.

Accordingly, there are several concomitant challenges to be overcome and benefits to be gained in designing and manufacturing meal kit packaging that is acceptable to both consumers and retailers alike. Such advantages, however, are not limited to the housing of pasta by the meal kits, but extend to a variety of other foods as well.

BRIEF SUMMARY OF THE INVENTION

A microwavable food packaging system includes a tray formed from a base and a sidewall extending from the base which sidewall terminates in a free edge. The base and sidewall define an interior cavity. The free edge defines a tray opening. The base has a raised button extending into the cavity. A sleeve surrounds the tray. The sleeve includes a front panel having a display surface and is disposed adjacent to the tray opening and a rear panel disposed adjacent to the base. The sleeve adjacent to the base extends outwardly to form a leg upon which the sleeve and tray can be upstandingly placed. The tray is adapted to receive food pouch(es) within the cavity. The raised button stabilizes the center of gravity of the food packaging system when the food packaging system is placed in an upstanding position on the leg. Advantageously, at least one food pouch is disposed in the cavity. Advantageously, the tray opening is covered with a polymeric film that is sufficiently self-supporting to serve as a splatter guard by being placed over the tray opening when the tray is placed into a microwave for heating of food in the tray cavity.

A method for making a microwavable food packaging system that is stable when stood in an upright position provides a tray that includes a base and a sidewall extending from the base which sidewall terminates in a free edge. The base and sidewall define an interior cavity. The free edge defines a tray opening and the base has a raised button extending into the cavity. At least one food pouch containing food is placed within the cavity. A sleeve surrounding the tray is provided to include a front panel having a display surface and being located adjacent to the tray opening. The sleeve also includes a rear panel located adjacent to the base. The sleeve adjacent to the base extends outwardly to form a leg upon which the sleeve and tray can be upstandingly placed. The raised button stabilizes the center of gravity of the food packaging system when the food packaging system is placed in an upstanding position on the leg.

BRIEF DESCRIPTION OF THE DRAWINGS

For a fuller understanding of the nature and objects of the present invention, reference should be had to the following detailed description taken in connection with the accompanying drawings in which:

FIGS. 11–14 sequentially show the steps recommended for consumer to empty the food contents of the food packaging system into the tray and use the polymeric film cover as a splatter guard when microwave heating of the tray food contents;

FIG. 15 is a perspective view of an alternative embodiment of the food packaging system of FIG. 1 which is adapted to stand with its longitudinal axis vertical rather than sideways as is the design in FIG. 1;

FIG. 16 is a side elevational view of the food packaging system of FIG. 15;

The drawings will be described in detail below.

DETAILED DESCRIPTION OF THE INVENTION

There are many considerations when designing packaging for a microwavable food packaging system. Initially, the packaging must be able to be manufactured in a cost-effective manner. Next, the packaging needs to confirm to current shipping requirements, e.g., carton size, pallet size, etc. Next, the grocer must be able to stock the item on conventional-sized store shelving. Next, the grocer needs to be able to display the packaging so that the consumer can easily see the product and read the label to determine whether or not to purchase the product. Next, the consumer needs to be able to store the item at home in a conventional pantry. Next, the consumer needs to be able to readily gain access to the good item through the packaging. Next, the packaging needs to be compatible with the method of cooking the food, i.e., microwaving the food. Next, the packaging needs to be able to accommodate storing any leftovers in the refrigerator. Finally, the packaging needs to be easily and safety disposed of when the meal has been completely consumed.

Figure 1:
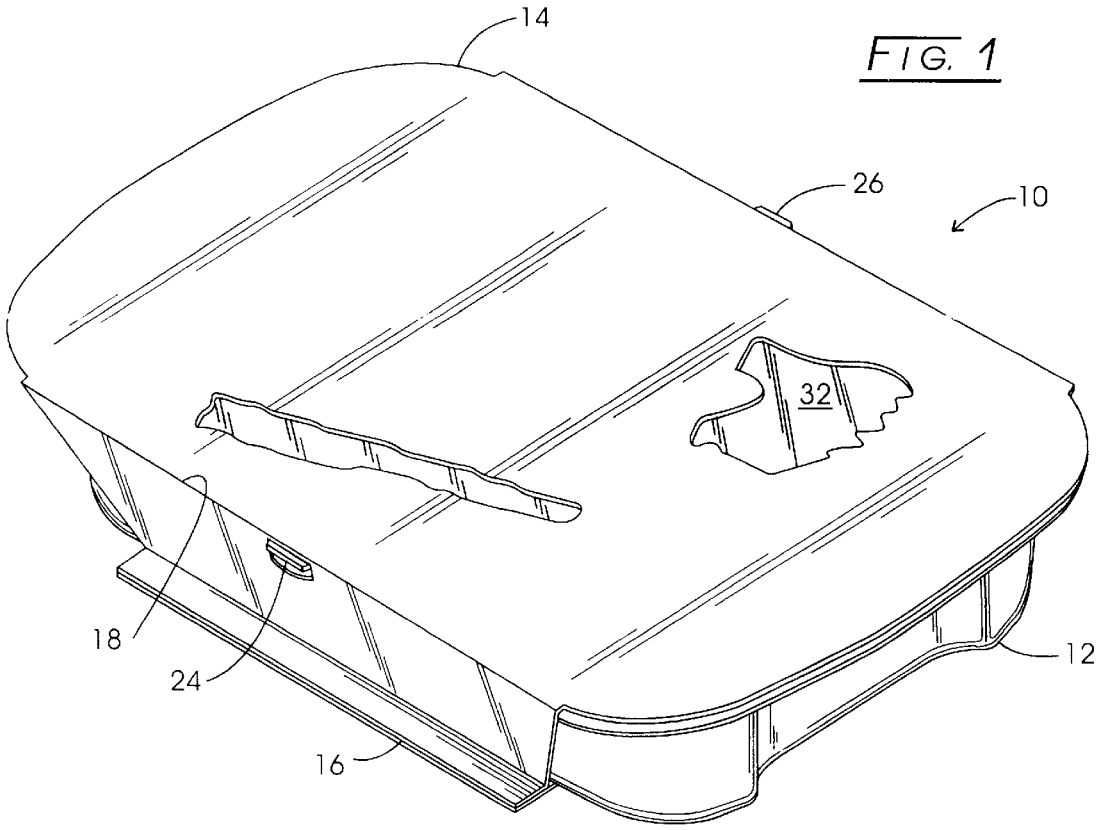
FIG. 1 is a perspective view of the microwavable food packaging system.
Figure 2:
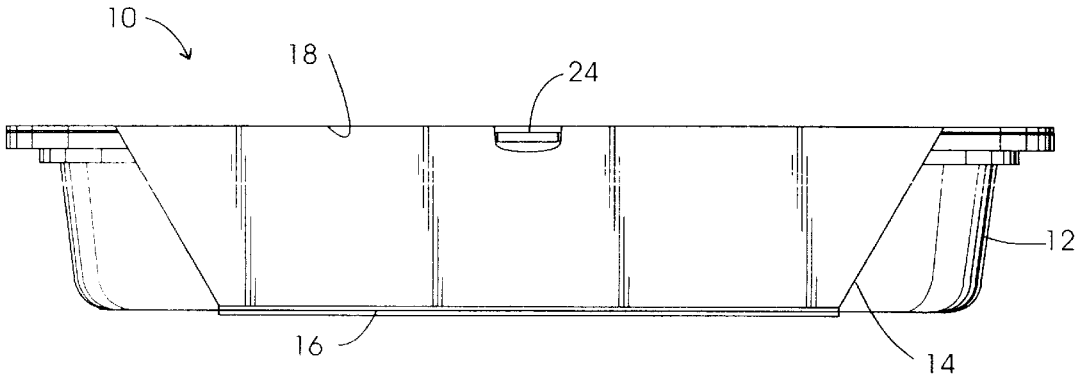
FIG. 2 is a side elevational view of the food packaging system of FIG. 1.
Figure 3:
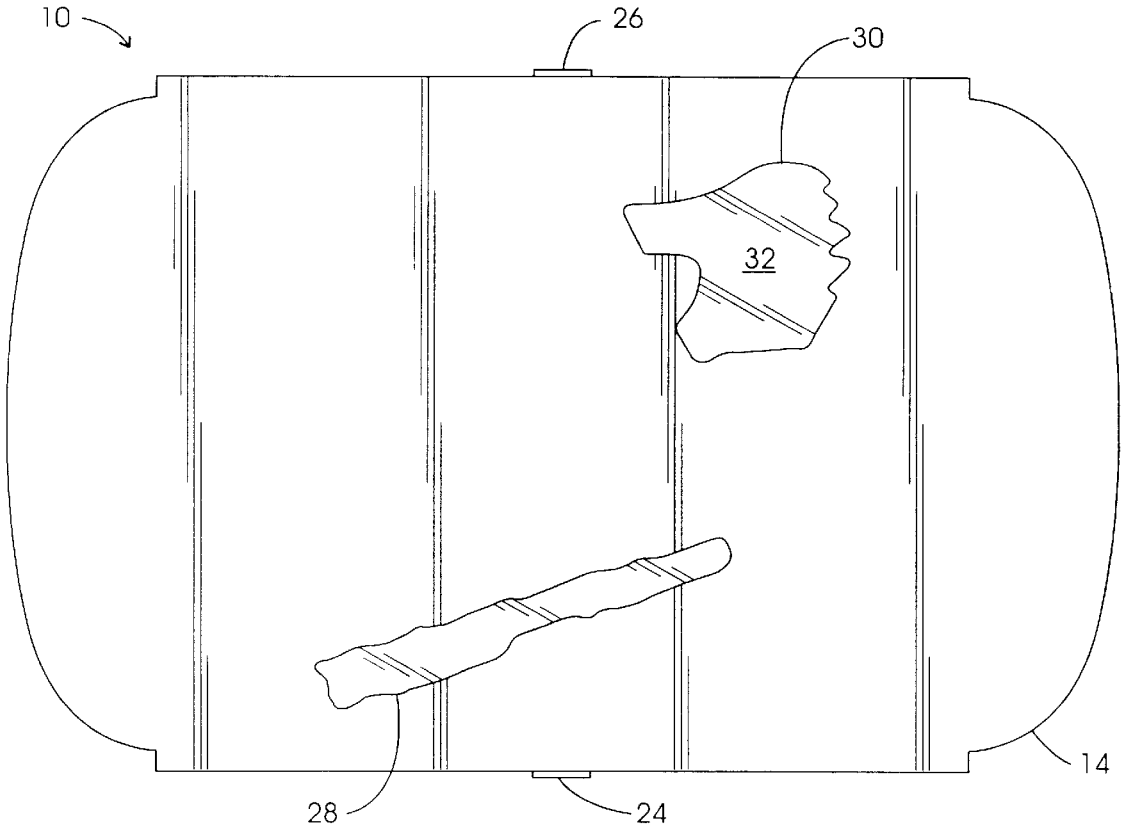
FIG. 3 is a top view of the of the food packaging system of FIG. 1.

It, thus, will be observed that the packaging designer is faced with numerous competing demands in designing packaging suitable for microwavable food packaging. The present packaging system responds to such diverse demands in a unique fashion. Referring initially to FIGS. 1–3, one embodiment of the microwavable food packaging system, generally identified as item 10, is illustrated in perspective view. Food packaging system 10 is seen to be composed of tray 12 and sleeve 14. For store display purposes, sleeve 14 is folded and sealed together in such a way that leg 16 is created. Leg 16 acting in cooperation with edge 18 forms a base upon which food packaging system 10 can rest in an upright or standing position. As depicted, food packaging system 10 would stand with its longitudinal axis in a horizontal position.

Additionally, sleeve 14 has a pair of apertures, 20 and 22 (see FIG. 5), which retain ears or dogs 24 and 26, respectively, for locking sleeve 14 to tray 12. Apertures 28 and 30 (see FIG. 5) permit the consumer to view the tray's contents prior to purchase. Polymeric film 32 can be seen beneath apertures 28/30 to cover the opening of tray 12 and retain any food items within the cavity of tray 12. Polymeric film 32 desirably is transparent for enhancing the viewing of the food items by the consumer through apertures 28/30.

Figure 4:
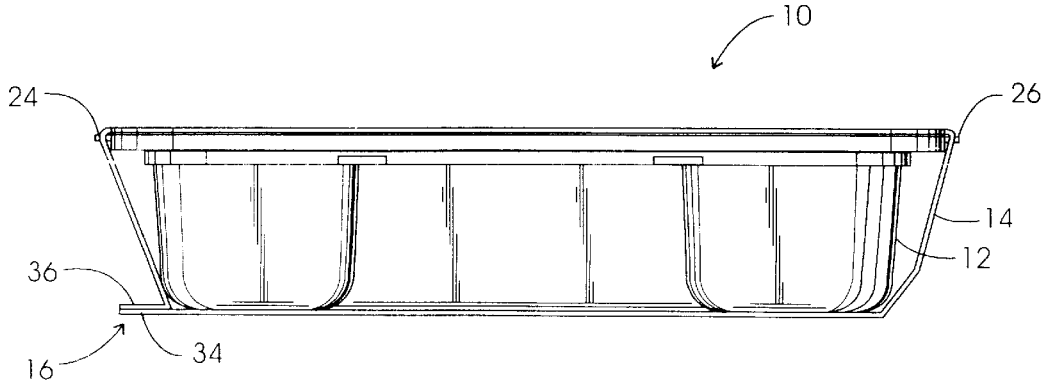
FIG. 4 is a side view of the food packaging system of FIG. 1.
Figure 5:
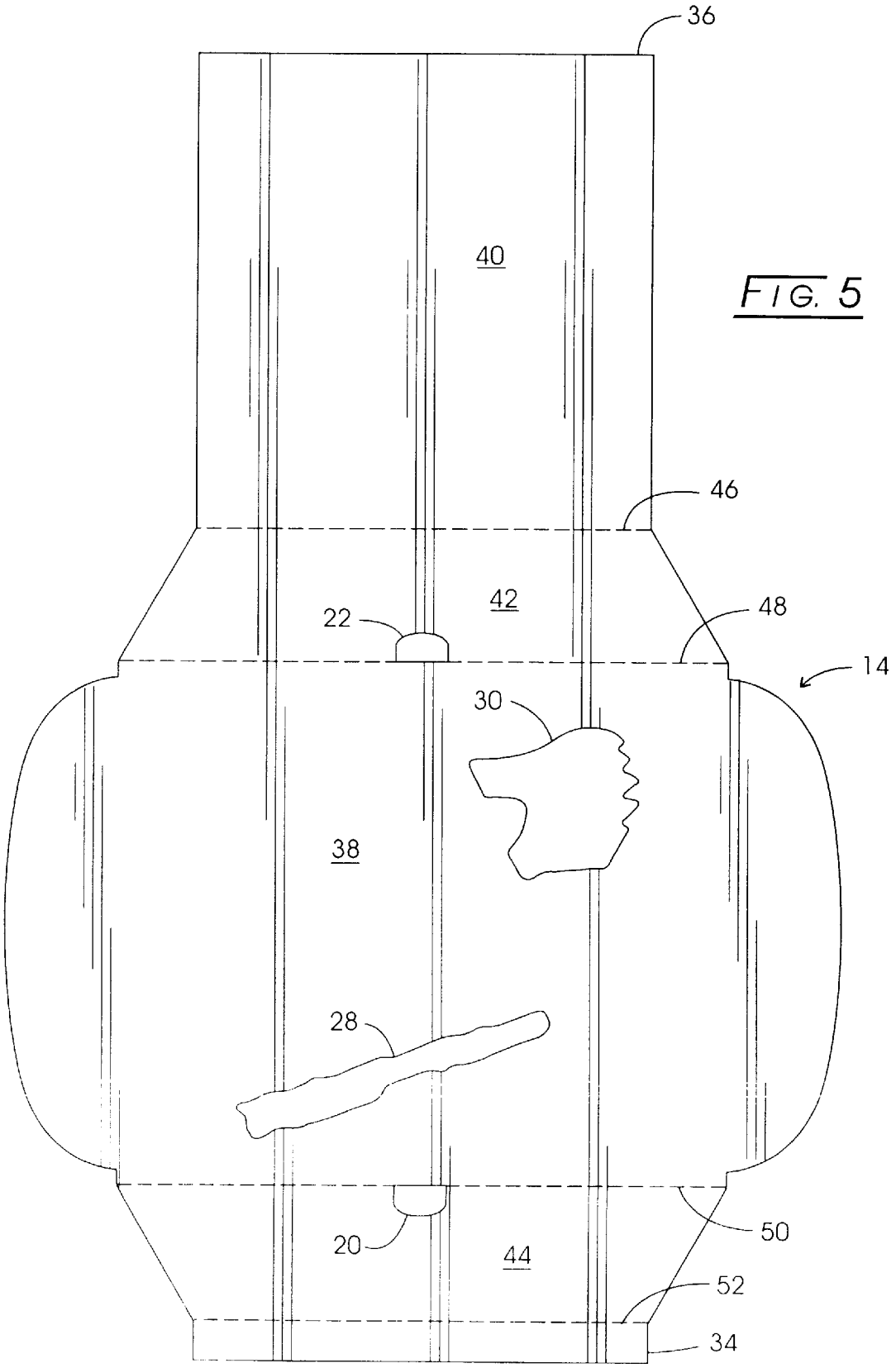
FIG. 5 is a top view of the sleeve of the food packaging system of FIG. 1 shown in an unfolded condition.

Referring to FIGS. 4 and 5, it will be observed that sleeve 14 has a pair of free edges that mate to form leg 16. The formation of leg 16 in this fashion is relatively simple to implement on a commercial scale. That is, edge 34 of sleeve 14 adjacent the bottom of tray 12 protrudes outwardly from the footprint of tray 12 while free edge 36 of sleeve 14 merely is bent outwardly at an angle of around 60° to mate with free edge 34. Adhesive, e.g., a hot melt adhesive, secures edges 34 and 36 together to form leg 16. Also, it will be appreciated that the length of sleeve 14 between edges 34 and 36 will be such that sleeve 14 is drawn tightly around tray 12 to assist in it being retained in position during storage and handling of food packaging system 10 in addition to ears 24 and 26 that lock through apertures 20 and 22, respectively.

Top surface 38 and bottom surface 40 of sleeve 14 desirably can be imprinted with a variety of consumer information ranging from word/logotype trademark(s) of the product to a description of the food items to cooking instructions to a list of food ingredients to nutritional information, etc. For that matter, so too can sides 42 and 44 be similarly imprinted. Also seen in FIG. 5 are fold lines 46, 48, 50, and 52 that are used to conform sleeve 14 to tray 12. Of course, printed indicia usually is imprinted on sleeve 14 prior to its being joined to sleeve 12. Sleeve 14, then, desirably is manufactured from paperboard stock, although it could be manufactured from polymeric stock.

Figure 6:
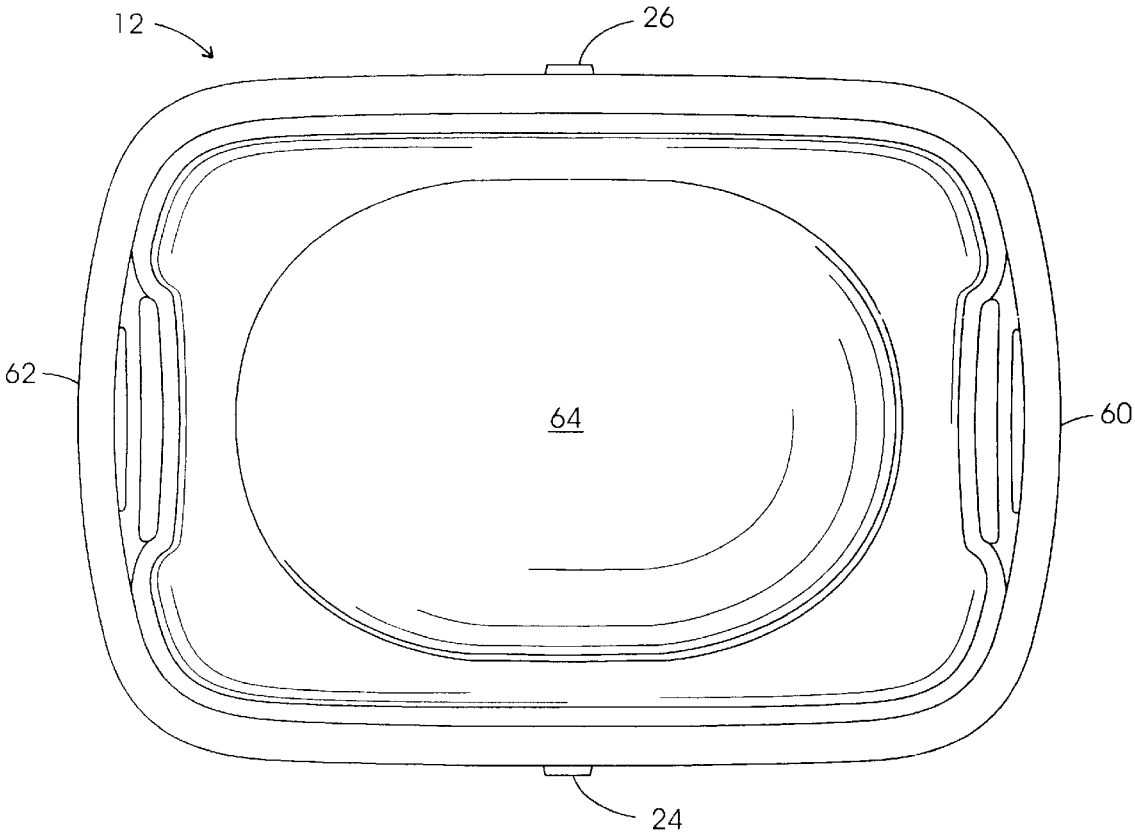
FIG. 6 is a top view of just the empty tray of the food packaging system of FIG. 1.
Figure 7:
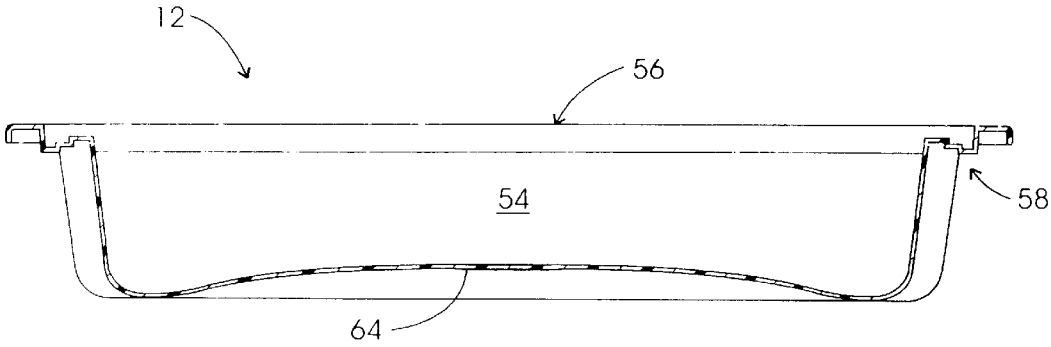
FIG. 7 is a cross-sectional elevational view of the empty tray of FIG. 7.

Referring to FIGS. 6 and 7, tray 12 will be seen to have cavity 54 formed by its four sideways and its bottom. Opening or mouth 56 permits foodstuffs to be placed with cavity 54 and removed therefrom. Lip or flange 58 is seen to traverse entirely around and form mouth 56. Its shape is dictated by strength and handling considerations as those skilled in this art will appreciate. Unique to tray 12 are handles 60 and 62 (see FIG. 8 also) on either longitudinal side of tray 12 for the consumer to easily pick up tray 12, especially when the food in cavity 54 is hot following the microwave heating operation. Handles 60/62 are seen in FIG. 6 to extend into cavity 54. Also unique to tray 12 is its bottom that has centrally-disposed button 64 that similarly penetrates into cavity 64. As will be illustrated and described later, handles 60/62 and button 64 penetrate into cavity 64 to locate foodstuffs in cavity 64 in a position that alters the center of gravity of food packing system 10 so that it is stable when stood up, e.g., for store display purposes. Internal handles 60/62 also reduce the overall width of tray 12, reduce the amount of material required for manufacturing tray 12, and provide a more stable product.

Tray 12 desirably is manufactured from polymeric stock, such as, for example, polypropylene, preferably pigmented (at least the outside) for consumer aesthetics. The polymeric stock used to manufacture tray 12 preferably also is transparent to microwave radiation. Cavity 54 can be designed to accommodate about a 16 oz. product. Tray 12 desirably measures about 9.6" in length (10" maximum) to accommodate store shelves and pallets that typically are 48" in length (i.e., 5 trays). The depth of tray 12 desirably is no more than 2" and its width is about 7". Button 64 also desirably penetrates into cavity 54 to about 0.375". Again, these measurements may be varied to accommodate different products and or shipping/display criteria.

Figure 8:
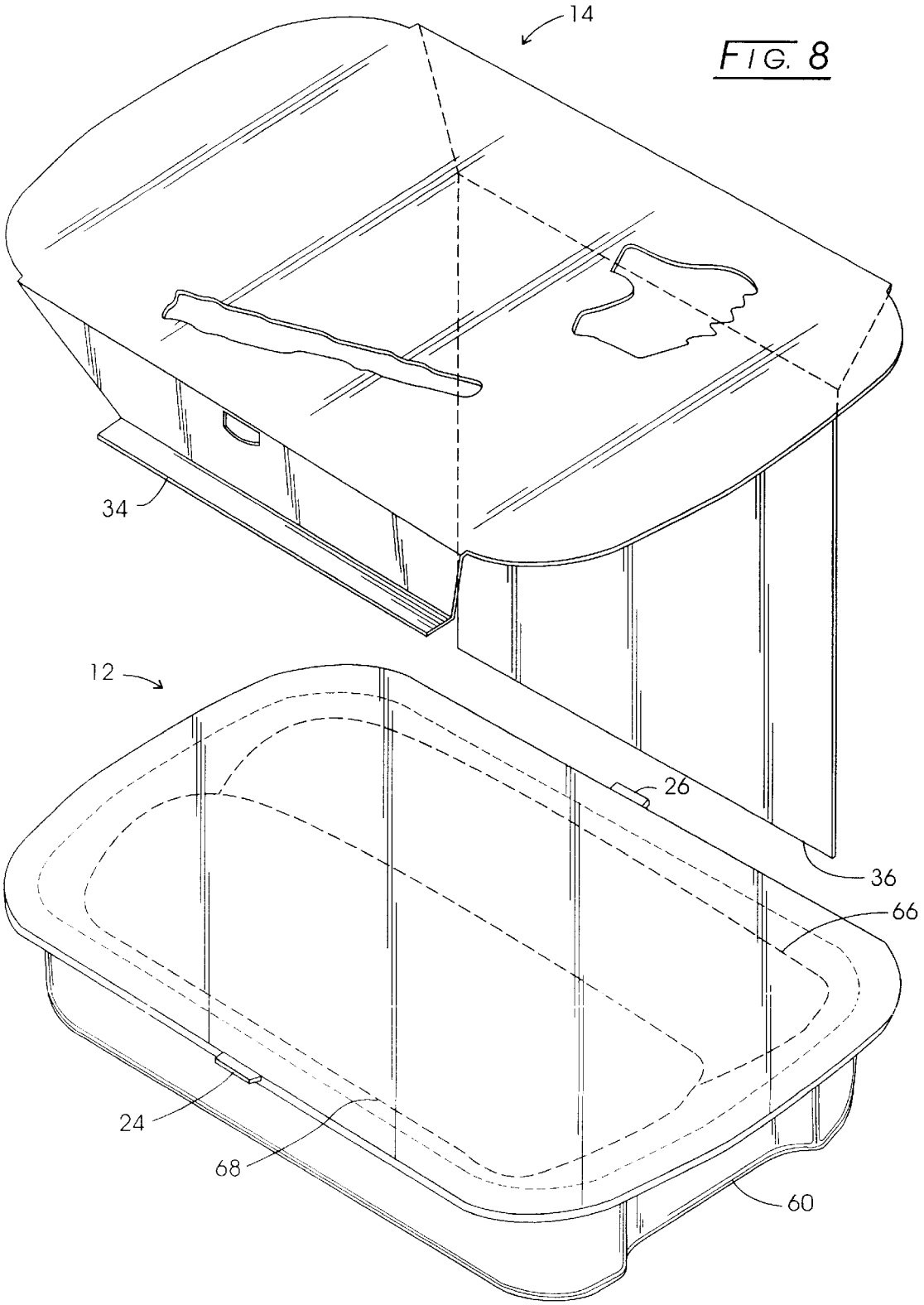
FIG. 8 is a perspective view of the food packaging system of FIG. 1 showing the sleeve and tray separately.

Two different methods for joining sleeve 14 to tray 12 can be envisioned. That is, sleeve 14 can be pre-folded and ends 34/36 adhesively joined to form a loop through which tray 12 is inserted into position under ears 24/26 lock into position with apertures 20/22. Alternatively, sleeve 14 can be placed around tray 12 and edges 34/36 glued in place. This alternative scheme is illustrated in FIG. 8. It will be observed that pouches 66 and 68 (e.g., aseptically packaged pasta pouch and a sauce pouch, such as shown in U.S. Pat. Nos. 5,057,330, 5,562,938, 5,433,964, and 5,759,607) are placed in cavity 54 of tray 12. Then, polymeric film 32 is placed over the opening of the cavity and, for example, adhesively joined to the upper side of lip 58. Sleeve 14 next is placed over tray 12 with ears 24 and 26 placed in apertures 20 and 22, respectively. Adhesive, e.g., a hot melt adhesive, has been applied to one or both of ends 34 and 36. Ends 34 and 36 are placed into registration and pressed to ensure their joining. This multi-step process can be simplified, however, if sleeve 14 has its ends 34/36 joined together first and then sleeve 14 slipped over tray 12. Regardless of the technique used to join sleeve 14 to tray 12, the same food packaging system 10 results.

Figure 9:
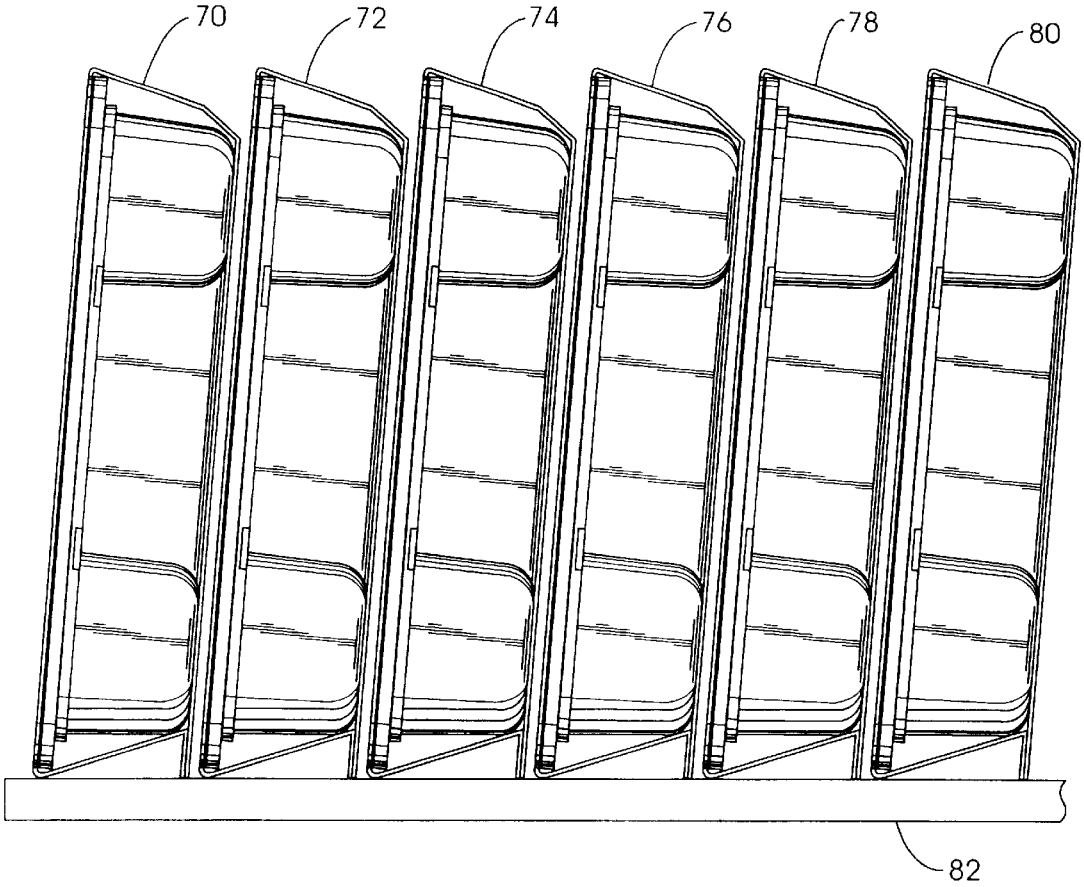
FIG. 9 is a side elevational view of 6 of the food packaging systems of FIG. 1 shown in a display mode as would be encountered in a grocery store.
Figure 10:
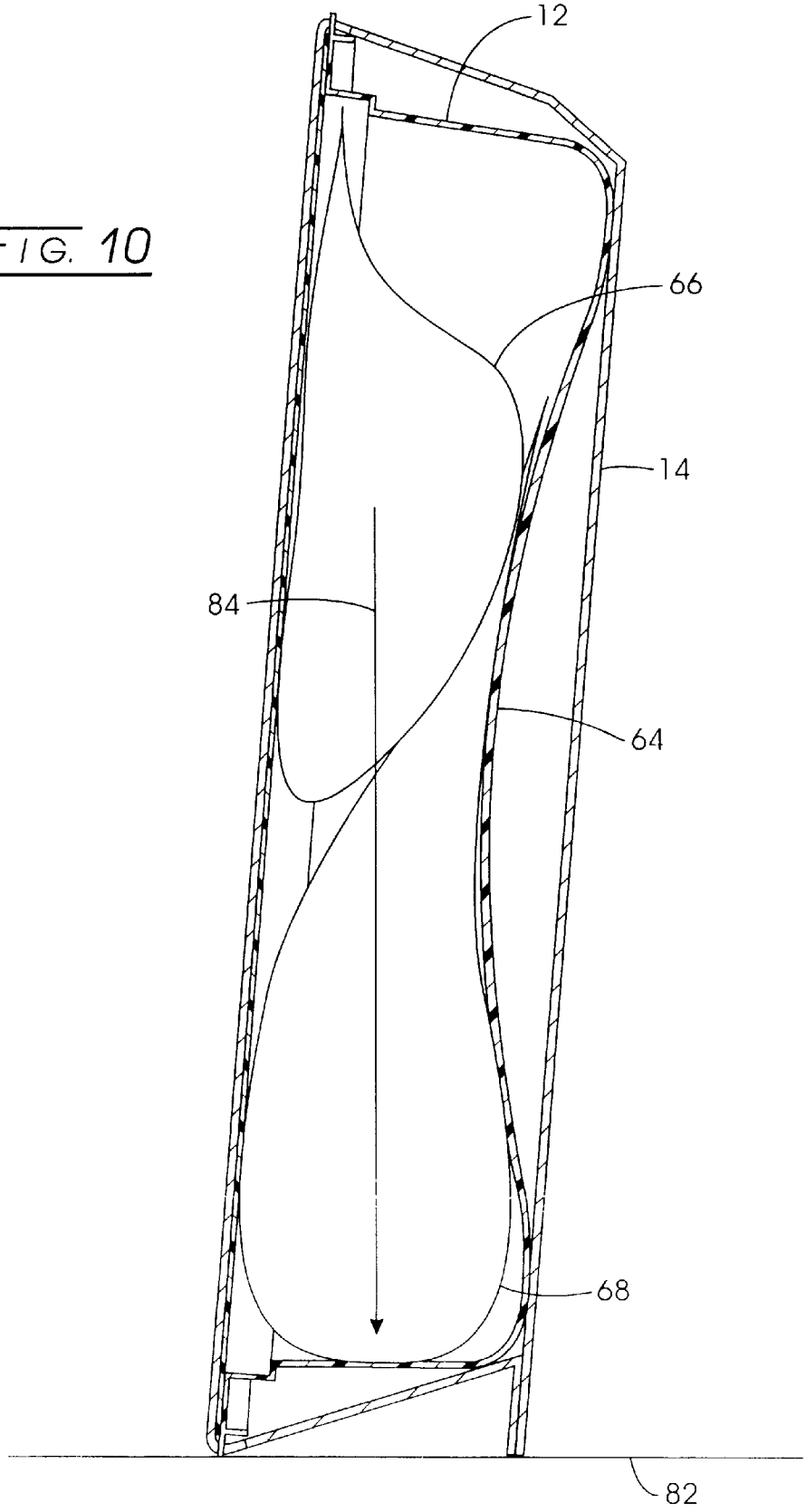
FIG. 10 is a cross-sectional elevational view of the food packaging system of FIG. 1 shown in an upright or standing mode as is depicted in FIG. 9.
Figure 11:
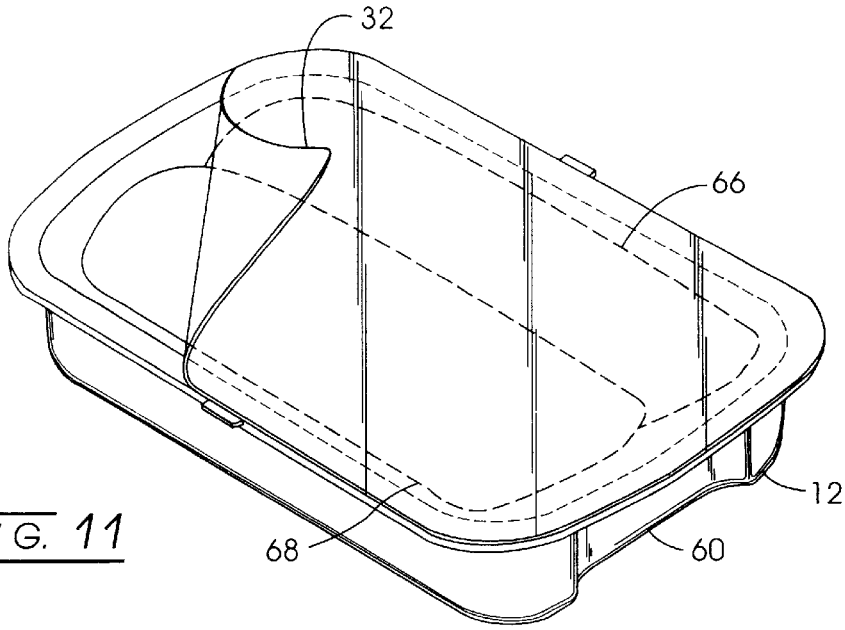
Figure 12:
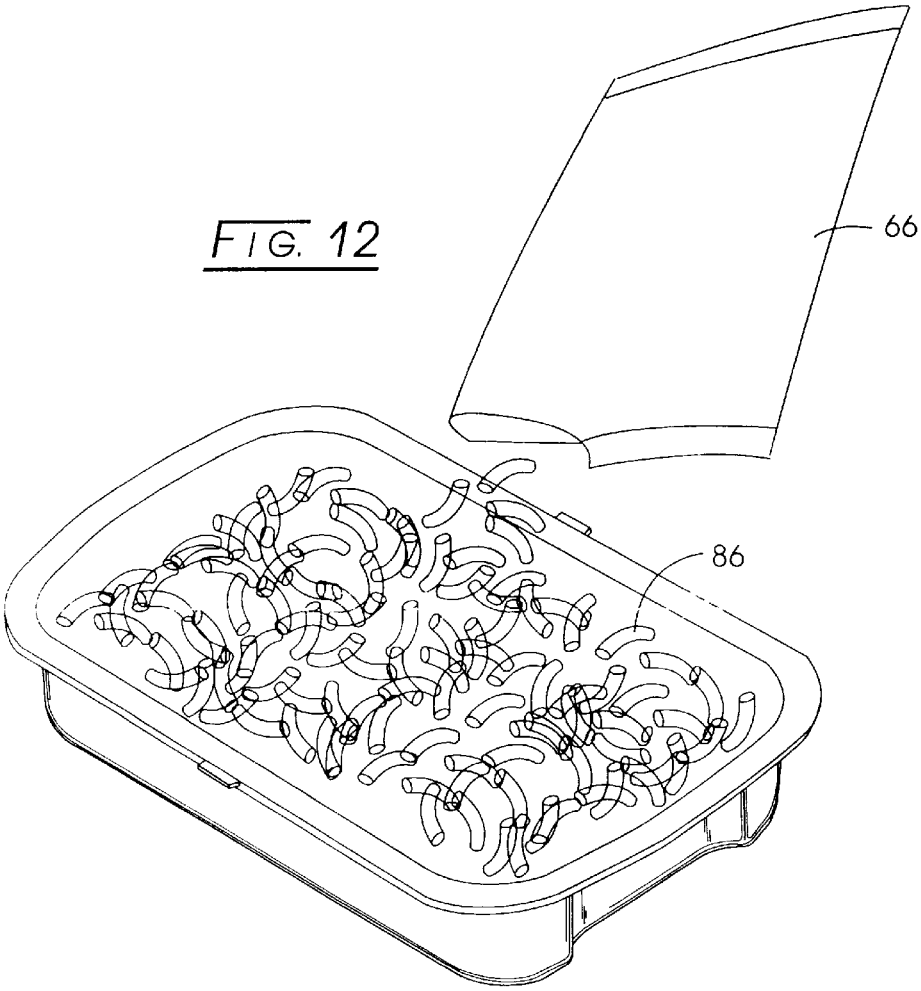

Referring to FIGS. 9 and 10, food packaging systems 70, 72, 74, 76, 78, and 80 are illustrated standing in an upright position on shelf 82. Such presentation of food packaging systems 70–80 will be made at a grocery store, for example, where consumers will browse and select such food items. It will be observed that top surface 40 of one food packaging system abuts against bottom surface 42 of an adjacent food packaging system. Each food packaging system is seen in an upstanding position, e.g., about 85°.

With more specific reference to FIG. 10, handles 60/62 urge the tray contents towards the center of cavity 54 while button 64 moves the center of gravity opposite the direction of lean of the food packaging system. This center of gravity, arrow 84, shift makes the food packaging system more stable when placed in the illustrated upright position.

Referring to FIGS. 11–14, depicted is the method whereby the foodstuffs housed within food packaging system 10 are removed and prepared for microwave heating. will be observed that sleeve 14 has been removed from tray 12 in these drawings. Thereafter, the consumer peels polymeric film from tray 12 to expose pouches 66 and 68. If pouch 66 holds aseptically packaged pasta and pouch 68 holds a tomato-based sauce, then the consumer can open pouch 66 and pour pasta 86 into the cavity of tray 12. Next, the consumer can open pouch 68 and pour tomato sauce 88 around the outside of pasta 86. Next, the consumer places polymeric film 32 back onto lip 58 to cover opening 56 of tray 12. In such a position, film 32 serves as a splatter guard when pasta/sauce filled tray 12 is placed in a microwave oven and heated. Simple removal of film 32 following heating permits the consumer to enjoy a pasta meal right from tray 12. The consumer need not, however, clean up the microwave oven from sauce splatters. Disposal of film 32 is easy also. Of course, the consumer could pour the heated pasta/sauce onto a plate or into a bowl to eat at the expense of extra dishes to clean.

It will be appreciated that film 32 needs to manufactured to be more than a simple seal to retain pouches 66/68 inside of tray 12. Rather, film 32 needs to have sufficient rigidity (often, thickness) so that it can be placed on lip 58 to cover opening 56 without moving such as to permit splatters to be released to contact the inside of the microwave oven. Presently, it is preferred that film 32 be manufactured from polyethylene terephthalate (PET), although other materials can be used as is necessary, desirable, or convenient. Pouch sizes of up to about 6"×8" can easily be accommodated by tray 12 with measurements as given above.

Figure 17:
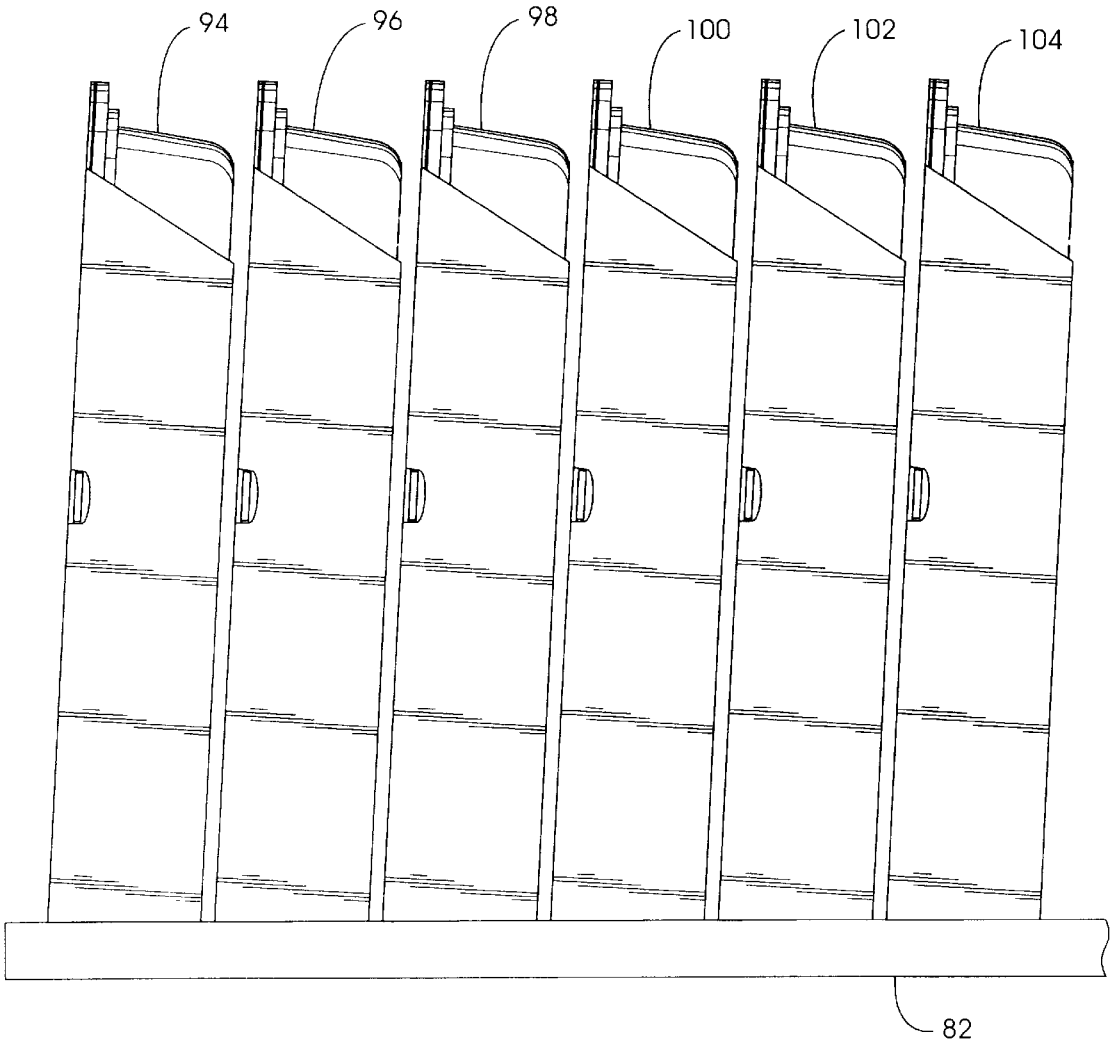
FIG. 17 is a side elevational view of 6 of the food packaging systems of FIG. 15 shown in a display mode as would be encountered in a grocery store.

FIG. 15 depicts an alternative embodiment where it is desired that food packaging system 90 stand upright with its longitudinal extent vertically oriented, rather than sideways as has been depicted and described above. In this vertical orientation, sleeve 92 has been modified so that one of its ends extends to the end of tray 12. This end sleeve configuration, then, permits food packaging system 90 to stand with its lengthwise extent vertically, such as is illustrated in FIG. 17. From FIGS. 15 and 16, it will be observed that sleeve 92 has a pair of apertures through which ears 24/26 can lock sleeve 92 with tray 12. Food packaging systems 94, 96, 98, 100, 102, and 104 stand in the same relationship as do food packaging systems 70–80 of FIG. 9. Button 64 again alters the center of gravity of each food packaging system to ensure stability when arranged as depicted in FIG. 17.

Figure 18:
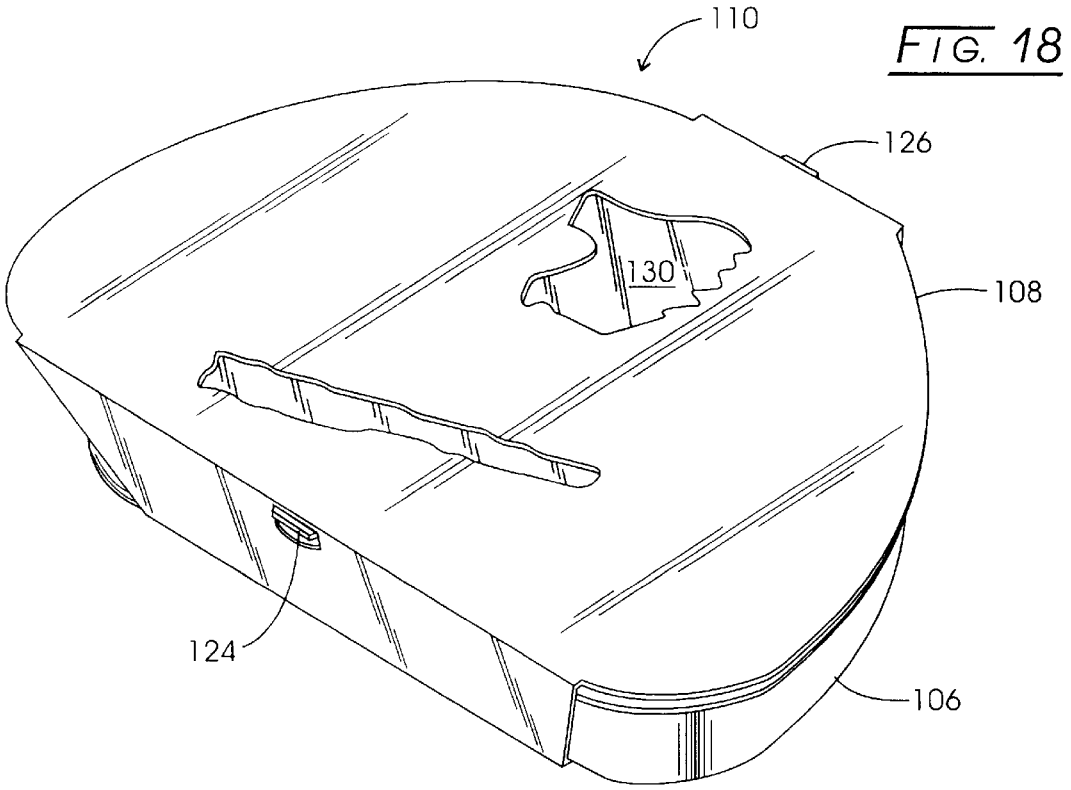
FIG. 18 is a perspective view of yet another embodiment of the food packaging system of FIG.
Figure 19:
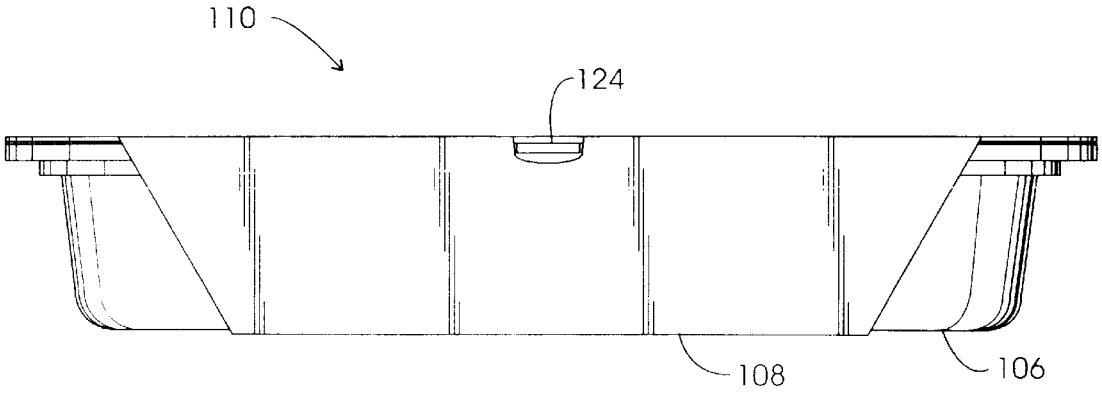
FIG. 19 is a side elevational view of the food packaging system of FIG. 18.
Figure 20:
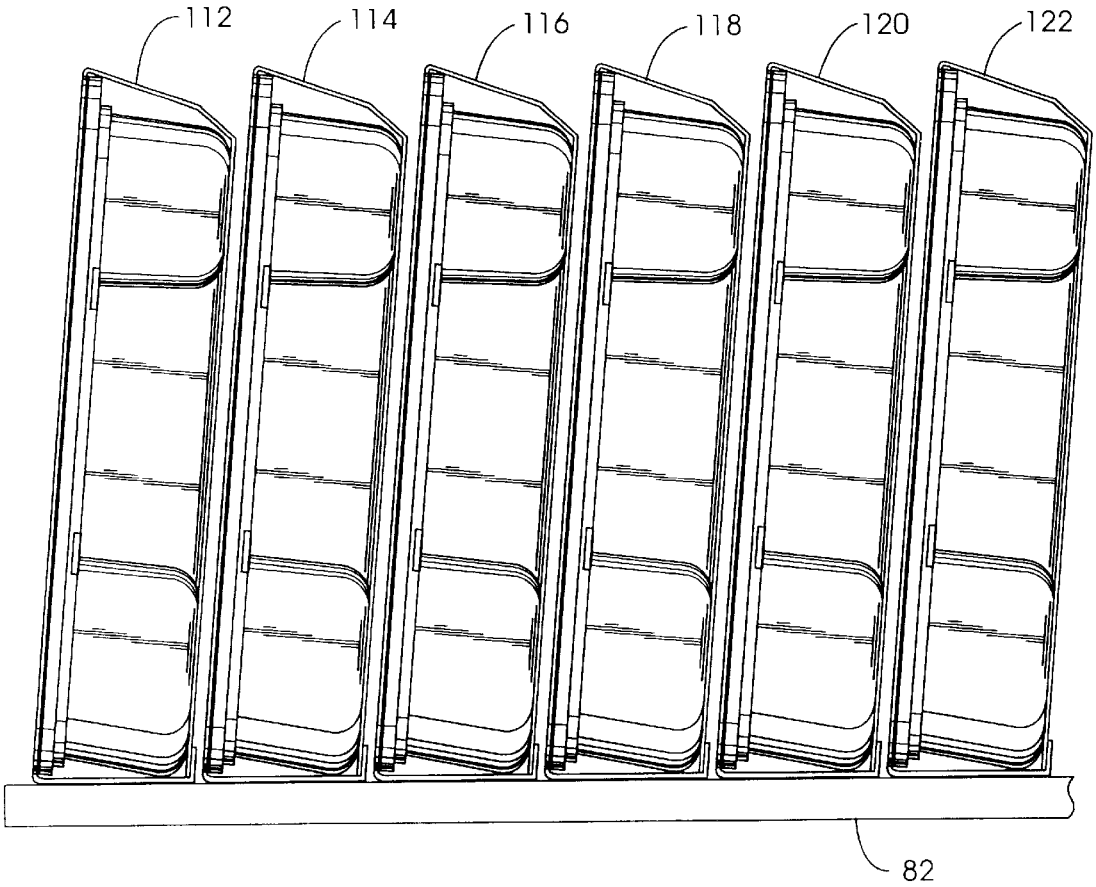
FIG. 20 is a side elevational view of 6 of the food packaging systems of FIG. 18 shown in a display mode as would be encountered in a grocery store.

FIGS. 18–20 depict yet another embodiment of the present invention where tray 106 has an elongate flat side and is surmounted by sleeve 108 that has a similar flat side adjacent to said tray flat side. Such flat side permits food packaging system 110 to stand upright, such as is depicted in FIG. 20 for food packaging systems 112, 114, 116, 118, 120, and 122. Tray 106 has ears 124 and 126 that poke through apertures in sleeve 108 so that tray 106 retains sleeve 108. Though not evident from the drawings, tray 106 also has a bottom button like button 64 for enhancing the upright stability of food packaging system 110 by altering the center of gravity. Handles also are provided for centering the food pouches therein and for enabling the consumer to carry the tray after foodstuff therein has been heated. Too, polymeric film 130 covers the cavity in tray 106.

Figure 21:
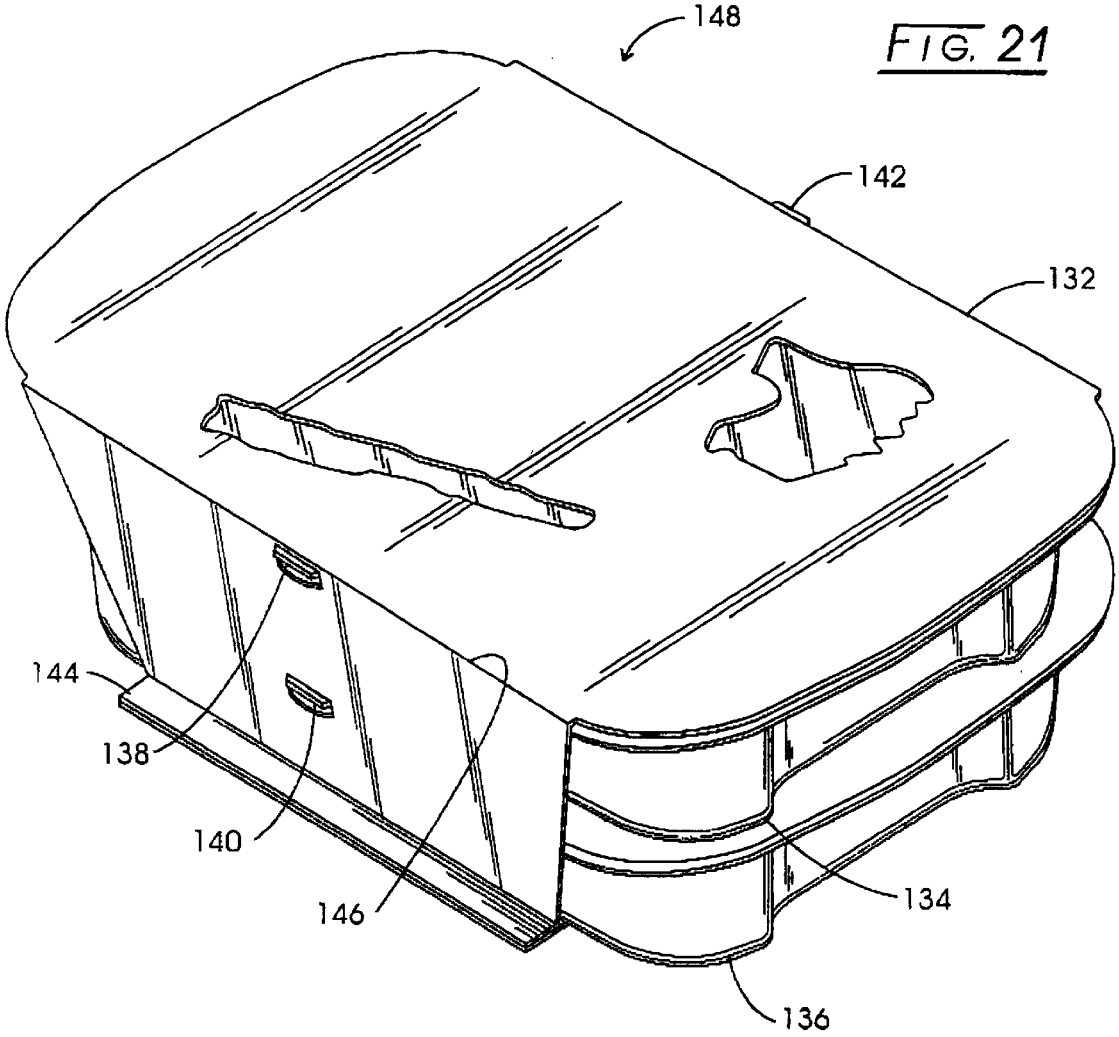
FIG. 21 is a perspective view of the food packaging system showing a pair of trays being retained by a single sleeve.

FIG. 21 shows an embodiment of the food packaging system like that illustrated in FIG. 1, except that sleeve 132 retains trays 134 and 136. Trays 134 and 136 are like the trays described above and are stacked one on top of the other. Tabs or ears 138 and 142 are retained in a pair of upper apertures in sleeve 132 while ears 140 and another not seen in FIG. 21 are retained by two lower apertures in sleeve 132. Its certainly is possible for each tray to utilize only one ear/aperture combination; although, presently a pair of ears is preferred. Also, it also is possible for only one of the trays to use the ears and rely on friction to retain the other tray in the sleeve. Sleeve 132 also has been fitted with foot 144 which with edge 146 of sleeve 132 permits food packaging system 148 shown in FIG. 21 to be stood up as described above. It will appreciated that more than two trays could be retained by a single sleeve and that the tray/sleeve configuration could be like any of the embodiments disclosed herein.

It will be appreciated that the foregoing description is illustrative of how the present invention can be practiced, but it should not be construed as limiting the present invention. Finally, all citations referred to herein are expressly incorporated herein by reference.

What is claimed is:

1. A tray, which comprises:

a base and a sidewall extending from said base which sidewall terminates in a free edge that retains a pair of oppositely-disposed ears, said base and sidewall defining an interior cavity, said free edge defining a tray opening, said cavity adapted to receive pouches of food, said base adapted to be placed in an upstanding position, said base having a raised button extending into said cavity for stabilizing the center of gravity of said base when said base is placed in an upstanding position when said cavity is filled with pouches of food;

said tray surrounded by a sleeve that contains slots adapted to receive said ears for said base to retain said sleeve.

2. The tray of claim 1, wherein said sidewall has a flat area upon which said tray can be placed in an upstanding position.

3. The tray of claim 1, wherein said sleeve includes a front panel having a display surface and being adjacent to said tray opening and a rear panel adjacent to the base, said sleeve adjacent to said base extending outwardly to form a leg upon which said sleeve and tray can be upstandingly placed.

4. The tray of claim 1, wherein at least one food pouch is contained in said cavity and said tray opening is covered with a cover.

5. The tray of claim 4, wherein said cover is one or more of a polymeric film or a sleeve that surrounds said tray.

6. The tray of claim 5, wherein said free edge terminates with a flange to which said polymeric film is releasably adhesively secured.

7. The tray of claim 6, wherein said tray opening is covered by said polymeric film and is surrounded by said sleeve.

8. A microwavable food packaging system, which comprises:

(a) a tray including a base and a sidewall extending from said base which sidewall terminates in a free edge that retains a pair of oppositely-disposed ears, said base and sidewall defining an interior cavity, said free edge defining a tray opening, said base having a raised button extending into said cavity; and (b) a sleeve surrounding said tray, said sleeve including a front panel having a display surface and being adjacent to said tray opening and a rear panel adjacent to the base, said sleeve adjacent to said base extending outwardly to form a leg upon which said sleeve and tray can be upstandingly placed, and said sleeve containing slots adapted to receive said ears for said tray to retain said sleeve, whereby said base is adapted to receive food pouches within said cavity, said raised button stabilizing the center of gravity of said food packaging system when said food packaging system is placed in an upstanding position on said leg.

9. The microwavable food packaging system of claim 8, wherein said sidewall carries a pair of handles disposed oppositely to each other which handles extend inwardly into said cavity to further stabilize said center of gravity when said cavity receives food pouches therewithin.

10. The microwavable food packaging system of claim 8, wherein said sidewall free edge terminates with a flange that extends generally perpendicularly from said sidewall.

11. The microwavable food packaging system of claim 10, wherein a polymeric film extends over said tray opening and is removably adhesively secured to said flange.

12. The microwavable food packaging system of claim 8, wherein said sleeve has a proximal edge that extends from said base, and wherein said sleeve also has a distal edge that is folded outwardly from said sidewall to meet and mate with said proximal edge to form said leg.

13. The microwavable food packaging system of claim 9, wherein said free edge retains a pair of oppositely-disposed ears and said sleeve contains slots adapted to receive said ears for said base to retain said sleeve.

14. The microwavable food packaging system of claim 13, wherein said free edge terminates with a flange that extends generally perpendicularly from said sidewall, wherein a polymeric film extends over said tray opening and is removably adhesively secured to said flange.

15. The microwavable food packaging system of claim 13, wherein said sleeve has a proximal edge that extends from said base, and wherein said sleeve also has a distal edge that is folded outwardly from said sidewall to meet and mate with said proximal edge to form said leg.

16. The microwavable food packaging system of claim 11, wherein a plurality of stacked trays are surrounded by said sleeve.

17. A microwavable meal kit and food packaging system, which comprises:

(a) a tray including a base and a sidewall extending from said base which sidewall terminates in a free edge that retains a pair of oppositely-disposed ears, said base and sidewall defining an interior cavity, said free edge defining a tray opening, said base having a raised button extending into said cavity;

(b) at least one food pouch disposed in said cavity; and (c) a sleeve surrounding said tray, said sleeve including a front panel having a display surface and being adjacent to said tray opening and a rear panel adjacent to the base, said sleeve adjacent to said base extending outwardly to form a leg upon which said sleeve and tray can be upstandingly placed, and said sleeve containing slots adapted to receive said ears for said tray to retain said sleeve, whereby said raised button stabilizes the center of gravity of said meal kit and food packaging system when said food packaging system is placed in an upstanding position on said leg.

18. The microwavable meal kit and food packaging system of claim 17, wherein said sidewall carries a pair of handles disposed oppositely to each other which handles extend inwardly into said cavity to further stabilize said center of gravity when said cavity receives food pouches therewithin.

19. The microwavable meal kit and food packaging system of claim 17, wherein said free edge retains a pair of oppositely-disposed ears and said sleeve contains slots adapted to receive said ears for said tray to retain said sleeve.

20. The microwavable meal kit and food packaging system of claim 17, wherein said sidewall free edge terminates with a flange that extends generally perpendicularly from said sidewall.

21. The microwavable meal kit and food packaging system of claim 20, wherein a polymeric film extends over said tray opening and is removably adhesively secured to said flange.

22. The microwavable meal kit and food packaging system of claim 17, wherein said sleeve has a proximal edge that extends from said base, and wherein said sleeve also has a distal edge that is folded outwardly from said sidewall to meet and mate with said proximal edge to form said leg.

23. The microwavable meal kit and food packaging system of claim 17, wherein said free edge terminates with a flange that extends generally perpendicularly from said sidewall, wherein a polymeric film extends over said tray opening and is removably adhesively secured to said flange.

24. The microwavable meal kit and food packaging system of claim 23, wherein said sleeve has a proximal edge that extends from said base, and wherein said sleeve also has a distal edge that is folded outwardly from said sidewall to meet and mate with said proximal edge to form said leg.

25. The microwavable meal kit and food packaging system of claim 21, wherein a plurality of stacked trays are surrounded by said sleeve.

26. A microwavable food packaging system, which comprises:

a tray including a base and a sidewall extending from said base which sidewall terminates in a free edge that retains a pair of oppositely-disposed ears, said base and sidewall defining an interior cavity, said free edge defining a tray opening, said base having a raised button extending into said cavity, said sidewall having a substantially flat sidewall portion adapted so that said tray can be placed in an upstanding position thereon, said tray surrounded by a sleeve that contains slots adapted to receive said ears for said base to retain said sleeve whereby said base is adapted to receive food pouches within said cavity, said raised button stabilizing the center of gravity of said food packaging system when said food packaging system is placed in an upstanding position on said sidewall flat portion.

27. The microwavable food packaging system of claim 26, wherein said sidewall carries a pair of handles disposed oppositely to each other which handles extend inwardly into said cavity to further stabilize said center of gravity when said cavity receives food pouches therewithin.

28. The microwavable food packaging system of claim 26, wherein said sidewall free edge terminates with a flange that extends generally perpendicularly from said sidewall.

29. The microwavable food packaging system of claim 28, wherein a polymeric film extends over said tray opening and is removably adhesively secured to said flange.

30. The microwavable food packaging system of claim 26, wherein said sleeve includes a front panel having a display surface and being adjacent to said tray opening.

31. The microwavable food packaging system of claim 30, wherein said sleeve has a sleeve flat portion that covers said sidewall flat portion.

32. The microwavable food packaging system of claim 31, wherein a plurality of stacked trays are surrounded by said sleeve.

33. The microwavable food packaging system of claim 30, wherein at least one food pouch is disposed in said cavity.

34. The microwavable food packaging system of claim 30, wherein said tray is made from a microwave transparent polymer.

35. A method for making a microwavable food packaging system that is stable when stood in an upright position, which comprises:

(a) providing a tray that includes a base and a sidewall extending from said base which sidewall terminates in a free edge that is provided as retaining a pair of oppositely-disposed ears, said base and sidewall defining an interior cavity, said free edge defining a tray opening, said base having a raised button extending into said cavity;

(b) placing at least one food pouch containing food within said cavity; and (c) providing a sleeve surrounding said tray, said sleeve including a front panel having a display surface and being adjacent to said tray opening and a rear panel adjacent to the base, said sleeve adjacent to said base extending outwardly to form a leg upon which said sleeve and tray can be upstandingly placed, and said sleeve containing slots adapted to receive said ears for said tray to retain said sleeve, whereby said raised button stabilizes the center of gravity of said food packaging system when said food packaging system is placed in an upstanding position on said leg.

36. The method of claim 27, wherein said sidewall is provided as carrying a pair of handles disposed oppositely to each other which handles extend inwardly into said cavity to further stabilize said center of gravity.

37. The method of claim 35, wherein said sidewall free edge is provided as terminating with a flange that extends generally perpendicularly from said sidewall.

38. The method of claim 37, wherein a polymeric film is provided as extending over said tray opening and is removably adhesively secured to said flange.

39. The method of claim 35, wherein said sleeve is provided as having a proximal edge that extends from said base, and wherein said sleeve also has a distal edge that is folded outwardly from said sidewall to meet and mate with said proximal edge to form said leg.

40. The method of claim 35, wherein said free edge is provided as terminating with a flange that extends generally perpendicularly from said sidewall, wherein a polymeric film extends over said tray opening and is removably adhesively secured to said flange.

41. The method of claim 40, wherein said sleeve is provided as having a proximal edge that extends from said base, and wherein said sleeve also has a distal edge that is folded outwardly from said sidewall to meet and mate with said proximal edge to form said leg.

42. The method of claim 38, wherein a plurality of stacked trays are provided surrounded by said sleeve.

43. The method of claim 38, wherein:

(d) said polymeric film is removed from said tray;

(e) said food in said at least one food pouch is poured into said tray;

(f) said removed polymeric film is placed over said tray opening; and (g) said tray is placed in a microwave for heating of the food in said tray, said removed polymeric film for retarding splatters during hearing.

* * * * *